United States Patent [19]

Zanarini

[11] 4,345,880

[45] Aug. 24, 1982

[54] MULTI-STAGE, RECIPROCATING, POSITIVE DISPLACEMENT COMPRESSOR

[75] Inventor: Franco Zanarini, Castel Maggiore, Italy

[73] Assignee: Safe S.r.l., Bologna, Italy

[21] Appl. No.: 158,523

[22] Filed: Jun. 11, 1980

[30] Foreign Application Priority Data

Aug. 28, 1979 [IT] Italy ..... 4915/79[U]

[51] Int. Cl.[3] ..... F04B 3/00; F04B 25/00; F04B 35/00

[52] U.S. Cl. ..... 417/264; 417/266; 417/400

[58] Field of Search ..... 417/264, 254, 266, 258, 417/400, 404

[56] References Cited

U.S. PATENT DOCUMENTS

Re. 13,645 11/1913 Stone ..... 417/266

4,111,609 9/1978 Braun ..... 417/254

*Primary Examiner*—Richard E. Gluck

*Attorney, Agent, or Firm*—Fleit & Jacobson

[57] ABSTRACT

A multi-stage, reciprocating, positive displacement compressor, in which the various stages are coaxial one with the other. The compressor has a double acting, monorod, hydraulic jack and at least one piston guided to slide hermetically in a cylindrical chamber that is fixed to the support structure of the compressor; a cylindrical tubular liner that is fixed coaxially, at one extremity, to the aforementioned piston and points towards the jack. The cylindrical chamber is sealed, at the extremity pointing towards the jack, by a guide ring for the liner and, at the other extremity, by a disk. The piston and the cylindrical liner define in the cylindrical chamber the first and the second stage in the compressor. Third and fourth stages of the compressor are formed in a second cylindrical chamber coaxial with the first chamber and secured to the disk sealing the first chamber.

10 Claims, 2 Drawing Figures

MULTI-STAGE, RECIPROCATING, POSITIVE DISPLACEMENT COMPRESSOR

BACKGROUND OF THE INVENTION

This invention relates to a multi-stage, reciprocating, positive displacement compressor, in which the various compression stages are coaxial one with the other.

The compressor in question is envisaged having, as the means by which it is powered, a hydraulic jack whose rod is pivotally connected to the support structure of the compressor, and whose cylinder is coaxially connected to a piston that slides in a corresponding chamber. Coaxially connected to the said piston there is a cylindrical tubular liner that is pointed towards the jack and, in a first form of embodiment for the compressor, is at least partially wrapped around the cylinder of the jack but, in a second form of embodiment, defines the circular wall of the said cylinder of the jack; the liner and the piston defining, in the said chamber, the first and the second stage of the compressor.

The two-stage compressor of the foregoing type has, compared with compressors preceding the invention (and on the basis of the compression ratio and the positive displacement capacity being identical therewith), a considerably reduced axial development and allows the cooling of the piston of the compressor to be effected in a relatively easy way.

Furthermore, because of the provision of a spherical pivot for linking the rod of the jack to the support structure of the compressor, and of an additional spherical pivot for linking the cylinder of the jack to the piston, the only necessity is that of ensuring that the two bodies, that is to say, the piston-liner assembly and the cylindrical chamber, are coaxial. This makes it possible to limit the transverse thrust of the piston on the chamber, and of the tubular liner on the guides made in one end of the said chamber and this, by causing a decrease in the specific pressure between the sliding surfaces, and thus in the heat resulting from the sliding friction, has a positive effect on the number of strokes it is possible to give the piston-liner assembly without the gaskets and the sliding rings placed on the sliding surfaces being heated or abnormally worn.

The first form of embodiment for the compressor in question also includes a type with three or four stages, the third and the fourth stage being obtained through a plunger-cylinder group, in which the rod of the plunger is coaxially connected to the aforementioned piston, on the opposite side to the jack.

DESCRIPTION OF THE PRIOR ART

The known multi-stage, reciprocating, positive displacement compressors, in which the stages are coaxial one with the other, can virtually be divided into two types.

The first type is substantially constituted by a single body consisting of a step piston that slides, enclosed hermetically, in a corresponding cylindrical chamber and defines, in the said chamber, two or more compression stages. One extremity of the said piston is connected to drive means constituted by an electric motor, or by an internal combustion engine that terminates in a connecting rod-crank mechanism, or else by hydraulic powering means (generally in the form of a hydraulic jack).

The second type is provided with two coaxial pistons (of the step type, for example) each of which slides in a cylindrical chamber in order to define two or more compression stages, and in between which are interposed the drive means that are connected mechanically to both pistons.

The axial development of both the aforementioned types of compressors is considerable and, furthermore, the cooling of the moving parts of the compressors (the pistons) calls for sophisticated (and costly) technical methods that are not always reliable from an operational viewpoint.

SUMMARY OF THE INVENTION

The object of the invention is to make available a multi-stage, reciprocating, positive displacement compressor, in which the various stages are coaxial one with the other, that has, compared with the types known, and on the basis of the compression ratio and the positive displacement capacity being identical therewith, a considerably lesser longitudinal development, and on the basis of the longitudinal development and the compression ratio being identical therewith, a considerably greater positive displacement capacity, and is, furthermore, so constructed as to allow the cooling of the moving parts thereof through the use of simple constructional contrivances.

The aforementioned object is achieved by the compressor in question which comprises a double acting, monorod, hydraulic jack secured, at the free end of the rod, to the support structure of the compressor, and connected to a control system for regulating the speed of both strokes of the cylinder, the said control system being interlocked to electrical means for intercepting the said cylinder, provided for reversing the stroke of the said cylinder and for regulating the amplitude of the stroke itself; essential features of the said compressor being that it is constituted by at least one piston that is coaxially connected to the head of the cylinder of the jack where the rod does not pass and is guided to slide hermetically in a cylindrical chamber fixed to the said support structure, and by a cylindrical tubular liner coaxially secured, at one extremity, to the aforementioned piston and pointing towards the said jack; the said cylindrical chamber being sealed, at the extremity that points towards the jack, by a guide ring for the said liner and, at the other extremity, by a disk; the said piston and the said cylindrical liner defining in the said cylindrical chamber the first and the second stage in the compressor in question.

In a first form of embodiment, the said liner is at least partially wrapped around the cylinder of the jack.

In a second form of embodiment, the said liner defines the circular wall of the cylinder of the jack.

BRIEF DESCRIPTION OF THE DRAWINGS

For the purpose of rendering more obvious further characteristics and advantages of the invention, a detailed description is given hereinafter of two preferred but not sole forms of embodiment for the compressor in question, illustrated purely as unlimited examples on the accompanying drawings, in which.

DESCRIPTION OF THE PREFERRED EMBODIMENTS

Figure 1:
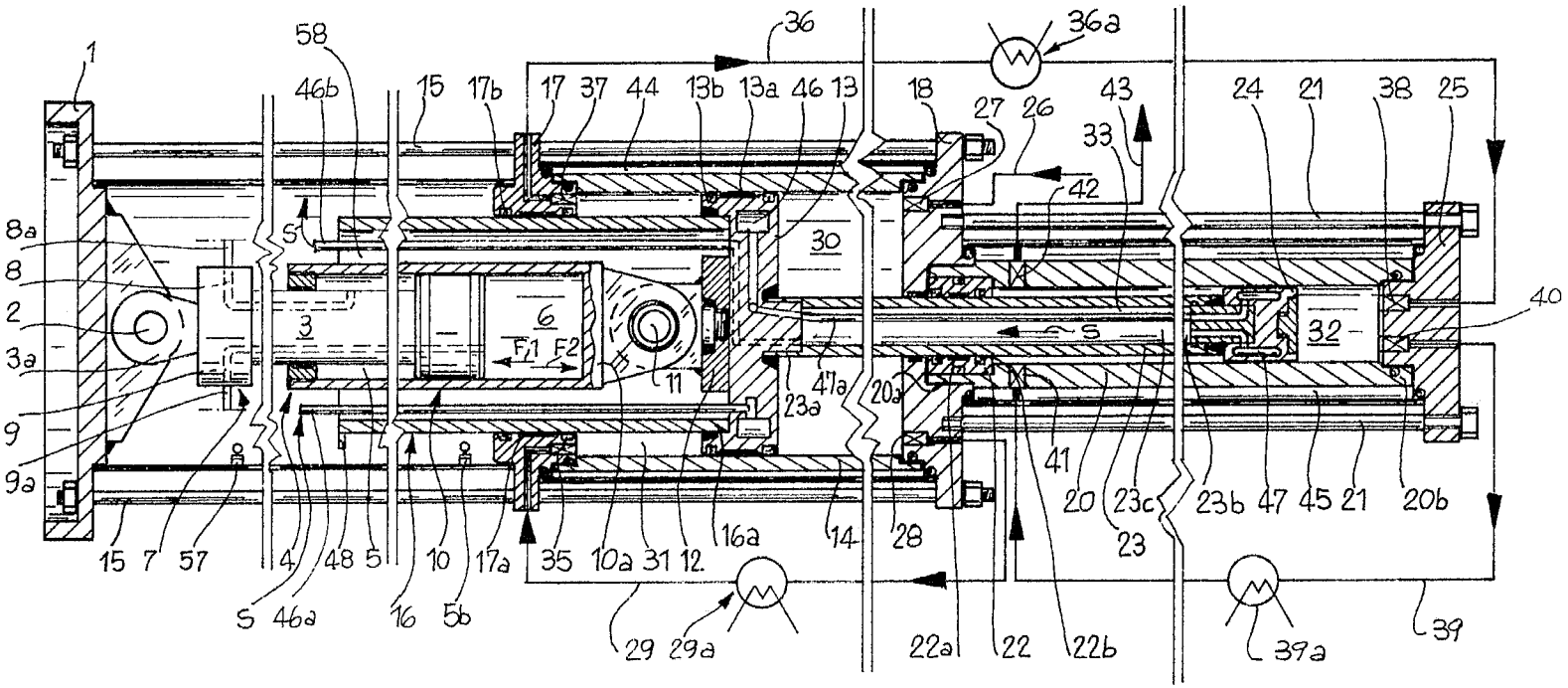
FIG. 1 shows, in an axial sectional view, the first form of embodiment for the compressor in question (wherein, for example, there are four stages)

With reference to FIG. 1, shown diagramatically at 1 is a part of the support structure of the compressor in question. Secured to the said structure by means of a ball joint 2 is the extremity 3*a* of a rod 3 that constitutes an integral part of a double acting, monorod, hydraulic jack 4.

The expansion chambers 5 and 6 of the jack are linked, by means of corresponding pipes 8 and 9, with a distributor 7 integral with the rod 3. At the distributor 7 terminate the lines 8*a* and 9*a* (illustrated only in part) that are connected to the pipes 8 and 9, respectively. The said lines 8*a* and 9*a* runs into a (non illustrated) oleo-dynamic system of a known type.

The cylinder 10 of the jack is secured, at the extremity 10*a* where the rod 3 does not pass, via a ball joint 11, to a plate 12 which, through systems of a known type, is in turn connected to a piston 13. The connection between the plate 12 and the piston 13 is such as to render the piston 13 and the cylinder 10 coaxial one with the other.

The piston 13 slides hermetically inside a cylindrical chamber 14 that is fixed, by means of the tie rods 15, to the structure 1 (the piston 13 is provided with suitable sliding rings 13*a* intended to limit the amount of the sliding friction between the piston and the inner surface of the chamber, and with sealing rings 13*b*).

To the face of the piston 13 pointing towards the jack 4 is coaxially fixed (by means of welding) the extremity 16*a* of a cylindrical tubular liner 16, the inside diameter of which is greater than the outside diameter of the cylinder 10. The liner 16 is pointed towards the jack 4 and is of a length such as to almost completely wrap around the circular wall of the cylinder 10.

The chamber 14 is sealed, at the extremity pointing towards the jack, by a ring 17 whose inner surface (where there are sliding rings 17*a* and sealing rings 17*b*) constitutes the guide for the axial reciprocating sliding movement (in accordance with what will be stated below) of the liner 16. The other extremity of the said chamber 14 is sealed by a disk 18 in the center of which there is a through hole designed to mate with the extremity 20*a* of a cylindrical chamber 20 that is secured to the said disk 18 by means of tie rods 21. The other extremity 20*b* of the chamber 20 is hermetically sealed by a disk 25 on which the said tie rods 21 act.

The inner part of the said extremity 20*a* is so shaped as to mate with a sleeve 22 housed in a seat defined by the particular conformation of the said extremity and of the disk 18. The inner surface of the sleeve 22 (where there are sliding rings 22*a* and sealing gaskets 22*b*) constitutes the guide for a tubular rod 23, one extremity 23*a* of which is fixed, through means of a known type, to the aforementioned piston 13, while the other extremity 23*b* thereof is connected to a plunger 24 that slides (hermetically) in the inside of the said chamber 20.

The piston 13 and the liner 16 define, inside the chamber 14, the first stage 30 and the second stage 31 of the compressor. More precisely, the stage 30 is delimitated, on one side, by the piston 13, and on the opposite side, by the disk 18, while in the center it is delimitated by the rod 23. The stage 31 is delimitated centrally by the liner 16 and laterally, on one side, by the piston 13 and, on the other, by the ring 17.

The plunger 24 and the rod 23 define, in the chamber 20, the third stage 32 and the fourth stage 33 of the compressor in question. More precisely, the stage 32 is delimitated laterally, on one side, by the plunger 24 and, on the other, by the disk 25. The stage 33 is delimitated centrally by the rod 23 and laterally, on one side, by the plunger 24 and, on the other, by the sleeve 22.

It is possible to connect the first stage 30 to a pipe 26 (belonging, for example, to the low pressure system for distributing the methane) with the consent of a check valve 27 of a known type. The same stage 30 can, with the consent of a check valve 28, by connected to a pipe 29 (in series with which is provided an inter-cooler 29*a* of a known type) and this can, in turn, be connected to the second stage 31 with the consent of a further check valve 35.

Likewise, it is possible to connect the second stage 31 to the third stage 32 via a pipe 36 (in series with which is provided an inter-cooler 36*a*) upstream and downstream of which there are check (or consent) valves 37 and 38. Similarly, the third stage 32 can be connected to the fourth stage 33 by means of a pipe 39 (in series with which is provided an inter-cooler 39*a*) upstream and downstream of which there are check valves 40 and 41. In conclusion, it is possible to connect the fourth stage 33, with the consent of a check valve 42, to a pipe 43 that runs into a (non illustrated) gas storage tank.

For the cooling of the chambers 14 and 20 provision is made in the circular walls of the said chambers for corresponding hollow spaces 44 and 45 that are bathed with suitable cooling fluids, the supply and discharge pipes of which have not been shown.

The operation of the above described compressor is, from what has been said in the foregoing description, obvious. The sending of oil under pressure into the pipe 8 causes the cylinder 10 (and the parts connected thereto) to move in direction $F_1$ and oil to pass through the pipe 9 from the expansion chamber 6. When, instead, oil under pressure is sent into the pipe 9, the cylinder 10 moves in direction $F_2$.

By regulating the delivery value of the oil, the mean speed of the stroke of the cylinder 10 is controlled in both directions. The amplitude of the said stroke is defined (and, if required, also regulated) by two micro limit switches 56 and 57, the armatures of which meet an external locator 48 with which the liner 16 is provided, and the tripping of one or the other of the said microswitches (connected to the aforementioned oleo-dynamic system) brings about the inversion of the delivery of oil under pressure to the expansion chambers 5 and 6.

The movement of the piston 13 in the directions $F_1$ and $F_2$ determines for the first stage 30, the suction of the gas (direction $F_1$) from the pipe 26, and the delivery of the gas (direction $F_2$) to the second stage 31 (which is in the suction phase). The second stage sends the twice compressed gas to the third stage 32 (direction $F_1$) which, in turn, in its compression phase (direction $F_2$) sends the thrice compressed gas to the fourth stage 33. The latter, in the relevant compression phase (direction $F_1$) sends the four times compressed gas into the pipe 43.

With the above mentioned compressor, compression ratios are achieved, between one stage and the next, variable from 3.5 to 4; for example, with a supply pressure of approximately one $Kg/cm^2$, the output pressure is, on an average, between 230 and 270 $Kg/cm^2$.

The fact of having the hydraulic jack 4 partially inside the liner 16 makes it possible to considerably reduce the longitudinal development of the compressor in question with respect to the four-stage compressors (of the type wherein the stages are coaxial) to be found on the market up until now.

The presence of the ball joints 2 and 11 prevents transverse components, caused by a possible misalignment between the axis of the rod 3 and that of the cylinder 10, from being passed onto the guide and sealing rings of the jack and, furthermore, stops the structure being hyperstatic.

The cylinder 10 moves the assembly consisting of the liner 16, the piston 13, the rod 23 and the plunger 24, which is made in such a way as to be symmetrical, at the sliding surfaces thereof, with respect to one and the same longitudinal axis made coincident with the axis of the cylinder 10. In this way the manufacturer must ensure the axis of the said assembly and the axes of the chambers 14 and 20 being coaxial.

The foregoing does not constitute any particular difficulty, also on account of the fact that because of what has been stated above, the longitudinal development of the compressor, and in particular of the two aligned chambers 14 and 20, is limited with respect to other known solutions. Indirectly, this latter point makes it possible to limit the transverse components and this restricts the wear of the said sliding rings or, alternatively, on the basis of the wear of the said rings being the same, allows the operator to increase the number of strokes (in the unit of time) of the jack 4 which, assuming the compression ratio to be the same, has a favorable effect on the productivity ($m^3$ of compressed gas supplied per hour) of the said compressor.

Because of the particular conformation of the above mentioned compressor, the piston 13, the plunger 24 and the rod 23 can easily be cooled. For this purpose it is necessary to provide a cooling circuit comprising, placed in series in an orderly fashion, a pipe **46*a* (partly flexible), an annular hollow 46 (in the piston 13), a pipe 47*a* that passes through the axial hole 23*c* in the rod 23, an annular chamber 47 (provided in the plunger 24), the aforementioned hole 23*c* and a pipe 46*b* (partly flexible). The pipes 46*a* and 46*b* run through the hollow space 58 that exists in between the cylinder 10 and the liner 16**.

In the said circuit there is a suitable cooling fluid, shown at S, which bathes in succession the hollow 46, the chamber 47 and the hole **23*c*, after which it cools the piston 13, the plunger 24 and the rod 23**.

The cooling of the piston 13, the plunger 24 and the rod 23 permits the limitation therein of thermal expansion and this consequentially brings about a restriction in the specific pressures that the associated guide and sealing rings exert on the corresponding sliding surfaces, with all the obvious advantages to be derived there from.

Should the pressure of the supply gas (pipe 26) be at around 20–30 $Kg/cm^2$, two stages are sufficient to obtain an output of 230–270 $Kg/cm^2$. In this event, the compressor does not comprise the chamber 20, the plunger 24 or the rod 23.

Figure 2:
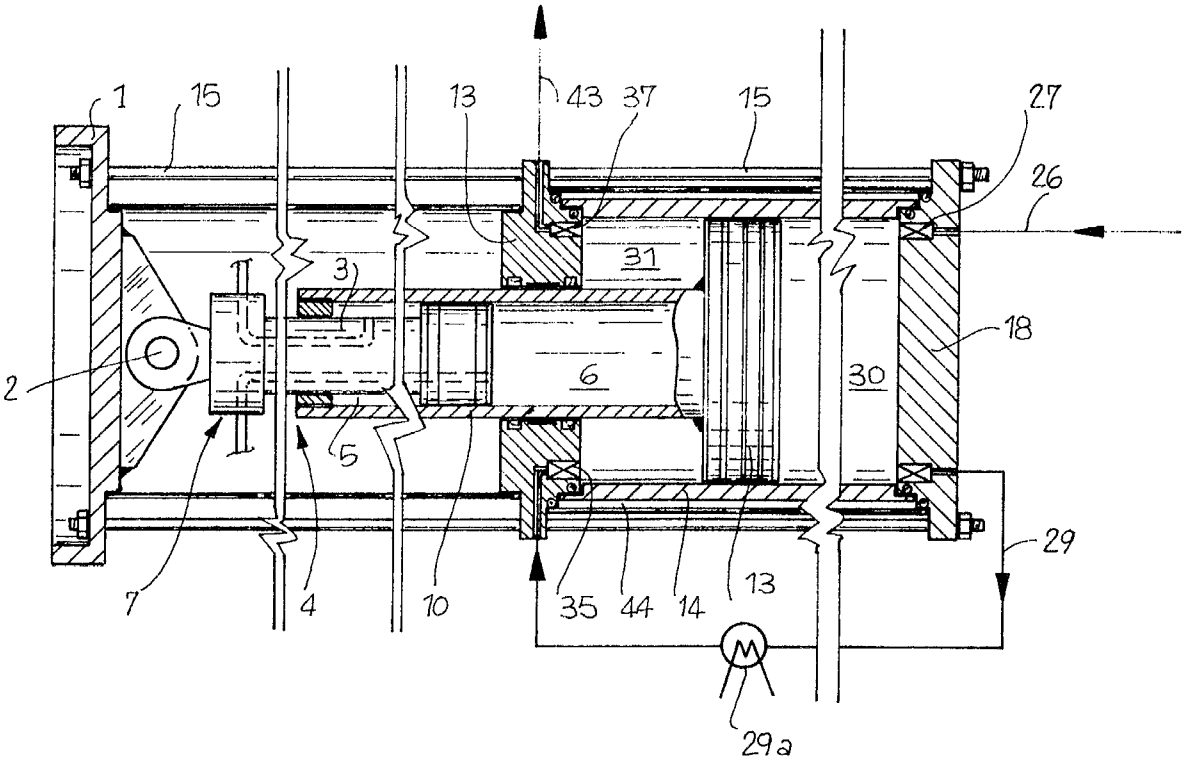
FIG. 2 shows, in an axial sectional view, the second form of embodiment for the compressor in question (wherein, for example, there are two stages).

If the volume of the second stage 31, in the two stage compressor built in accordance with the foregoing, were such as not to allow the coexistence of the liner 16 with the cylinder 10, one would have to resort to the constructional variant illustrated in FIG. 2 from which it can be seen that the liner 16 defines the circular wall of the cylinder 10 and that the ball joint 11 is missing.

A compressor of the above described type can directly supply the storage tanks without danger of explosions. It is, in fact, sufficient just to make provision of the oleo-dynamic system for operating the jack for a maximum pressure valve for the oil being fed to the said jack which comes into operation if, in the case of hyper-compression in any one stage of the compressor, the maximum pressure valve (not shown on the accompanying drawings) of the stage in question fails to operate.

It is understood that the foregoing description, given purely as an unlimited example, may be varied, adapted or combined without this being in any way a deviation from the framework of protection afforded to the invention as described above and claimed hereunder, or from the objects thereof.

What is claimed is:

1. A multi-stage reciprocating, positive displacement compressor having first and second ends and comprising:

a support structure forming the first end of said compressor;

a hydraulic jack having an axially-extending rod with a first end secured to said support structure and a second end extending towards said second end of said compressor, said rod forming a piston, and a cylinder encompassing the piston, the piston dividing the interior of the cylinder into first and second expansion chambers;

means for feeding fluid under pressure into said first and said second expansion chambers to thereby reciprocate said cylinder with respect to said rod;

a pumping piston coaxial with said cylinder and secured to an end of said cylinder closest to the second end of the compressor;

chamber defining means for defining a cylindrical chamber secured to said support structure, said cylindrical chamber being coaxial with and encompassing said pumping piston, said chamber defining means having a first end extending towards said first end of said compressor and a second end extending towards said second end of said compressor;

means for defining a first sliding hermetic seal between an interior surface of said cylindrical chamber and a peripheral surface of said pumping piston;

a cylindrical tubular liner coaxial with and inwardly spaced from said chamber defining means, a first end of said liner extending towards the first end of said compressor and a second end of said liner being secured to said pumping piston;

a guide ring secured to and extending inwardly from said first end of said cylindrical chamber defining means;

means for defining a second sliding hermetic seal between an interior surface of said guide ring and an exterior surface of said tubular liner;

a disk secured to and closing the second end of said cylindrical chamber defining means so as to form a first compressor stage between said disk and said pumping piston, a second compressor stage being formed between said means defining said first sliding hermetic seal and said means defining said second sliding hermetic seal; and pipe means for connecting said first stage with fluid to be compressed, for connecting said first and said second stages, and for removing compressed fluid from said compressor.

2. A compressor according to claim 1, further comprising:

means for defining a second cylindrical chamber having first and second ends, extending towards first and second ends of said compressor, respectively, said second chamber being coaxial with said chamber secured to said support structure and having the first end thereof secured to said disk;

means for sealing the second end of said second chamber;

a plunger positioned inside said second chamber for sliding movement with respect to said second chamber, a third compressor stage being formed between an end of said plunger and said means for sealing;

a connecting rod inwardly spaced from interior walls of said second chamber, extending through said disk, and interconnecting said plunger with said pumping piston;

means carried by said disk for guiding sliding hermetic movement of said connecting rod with respect to said disk, a fourth stage of said compressor being formed between said connecting rod, said plunger, interior walls of said second chamber, and said means carried by said disk; and said pipe means including means for connecting said second stage and said third stage and for connecting said third stage and said fourth stage.

3. A compressor according to claim 2, wherein said tubular liner is spaced from said cylinder, said compressor further comprising means for cooling said compressor comprising:

an annular hollow space formed in said pumping piston, and coolant pipe means extending through the space between said tubular liner and said cylinder for feeding cooling fluid into said hollow space.

4. A compressor according to claim 3, wherein said connecting rod is tubular in shape and wherein said means for cooling further comprises:

an annular hollow space formed in said plunger; and said coolant pipe means further comprising means for interconnecting said annular hollow space of said plunger with said annular hollow space of said pumping piston.

5. A compressor according to claim 4, wherein said coolant pipe means has an inlet end, a first portion extending from said inlet end through said space between said tubular liner and said cylinder to said pumping piston, a second portion extending between said pumping piston and the hollow space of said plunger, a passageway formed in said pumping piston interconnecting said first and second portions, a third portion interconnecting said hollow spaces of said plunger and said pumping piston, and a fourth portion extending from said hollow space of said pumping piston to an outlet of said coolant pipe means.

6. Compressor according to claim 1, wherein the liner is at least partially wrapped around the cylinder of the jack.

7. Compressor according to one of claims 1, 2 or 6, wherein a pivot connection is provided between the cylinder and the said pumping piston.

8. A compressor according to claim 1 or claim 6, wherein said tubular liner is spaced from said cylinder, said compressor further comprising means for cooling said compressor comprising:

an annular hollow space formed in said pumping piston, and coolant pipe means extending through the space between said tubular liner and said cylinder for feeding cooling fluid into said hollow space.

9. Compressor according to claim 1 or claim 2, wherein a pivot connection is provided between the free extremity of the rod of the hydraulic jack and the support structure of the said compressor.

10. Compressor according to claim 1 or 2, wherein the liner defines the circular wall of the cylinder of the jack.

* * * * *

UNITED STATES PATENT AND TRADEMARK OFFICE

CERTIFICATE OF CORRECTION

PATENT NO. : 4,345,880

DATED : August 24, 1982

INVENTOR(S) : Franco ZANARINI

It is certified that error appears in the above-identified patent and that said Letters Patent are hereby corrected as shown below:

On the title page, before line "[51]" insert:

Aug. 28, 1979 [IT] Italy ..... 4915B/79

Signed and Sealed this

Ninth Day of November 1982

[SEAL]

*Attest:*

GERALD J. MOSSINGHOFF

*Attesting Officer* *Commissioner of Patents and Trademarks*